US011499554B2

(12) United States Patent
Olsen

(10) Patent No.: US 11,499,554 B2
(45) **Date of Patent: *Nov. 15, 2022**

(54) COMPRESSOR FOR HIGH EFFICIENCY HEAT PUMP SYSTEM

(71) Applicant: Lennox Industries Inc., Richardson, TX (US)

(72) Inventor: Mark W. Olsen, Carrollton, TX (US)

(73) Assignee: Lennox Industries Inc., Richardson, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/644,214

(22) Filed: Dec. 14, 2021

(65) Prior Publication Data

US 2022/0106959 A1 Apr. 7, 2022

Related U.S. Application Data

(63) Continuation of application No. 16/718,492, filed on Dec. 18, 2019, now Pat. No. 11,255,325.

(60) Provisional application No. 62/930,253, filed on Nov. 4, 2019.

(51) Int. Cl.
*F04C 18/02* (2006.01)

(52) U.S. Cl.
CPC ..... *F04C 18/0215* (2013.01); *F04C 18/0269* (2013.01)

(58) Field of Classification Search
CPC ..... F04C 18/0207–0292
See application file for complete search history.

(56) References Cited

U.S. PATENT DOCUMENTS 4,613,291 A 9/1986 Sidransky
5,458,471 A * 10/1995 Ni ..... F04C 27/005 418/57

(Continued)

FOREIGN PATENT DOCUMENTS

EP 2039936 A1 3/2009
EP 2944898 A1 11/2015

(Continued)

OTHER PUBLICATIONS

European Patent Office, The Extended European Search Report, Application No. 20202809.8, dated Dec. 7, 2020, 7 pages.

*Primary Examiner* — Mark A Laurenzi
*Assistant Examiner* — Xiaoting Hu
(74) *Attorney, Agent, or Firm* — Baker Botts L.L.P.

(57) ABSTRACT

An HVAC system includes a compressor with an inlet port, an outlet port, and a scroll set. The scroll set includes a fixed scroll member and an orbiting scroll member. The fixed scroll member includes a first scroll wrap extending vertically from a base of the fixed scroll wrap. The first scroll wrap has an approximately spiral shape with at least 3.5 rotations from the center to the end of the spiral. The orbiting scroll member includes a second scroll wrap extending vertically from a base of the orbiting scroll wrap. The second scroll wrap has an approximately spiral shape with at least 3.5 rotations from the center to the end of the spiral. The orbiting scroll moves in an elliptical pattern such that fluid entering the inlet port of the compressor is compressed from a first volume to a second volume via movement of the orbiting scroll member.

14 Claims, 8 Drawing Sheets

(56) References Cited

U.S. PATENT DOCUMENTS

| | | | | |
|---|---|---|---|---|
| 5,855,475 | A * | 1/1999 | Fujio | F04C 29/128 418/55.1 |
| 5,863,190 | A * | 1/1999 | Yamamoto | F04C 29/128 62/324.1 |
| 9,297,381 | B2 | 3/2016 | Holbrook et al. | |
| 2002/0051719 | A1* | 5/2002 | Shiibayashi | F04C 18/0276 418/55.6 |
| 2006/0115371 | A1 | 6/2006 | Hiwata et al. | |
| 2009/0028724 | A1* | 1/2009 | Sun | F04C 28/18 417/310 |
| 2009/0071183 | A1 | 3/2009 | Stover | |
| 2013/0022486 | A1* | 1/2013 | Park | F04C 18/0215 418/55.1 |
| 2014/0119971 | A1* | 5/2014 | Shiibayashi | F04C 18/0215 418/55.5 |
| 2016/0131134 | A1* | 5/2016 | Kakuda | F01C 1/0246 418/55.1 |
| 2016/0238007 | A1 | 8/2016 | Kanemitsu et al. | |
| 2019/0309753 | A1 | 10/2019 | Jeon et al. | |
| 2021/0131430 | A1 | 5/2021 | Olsen | |

FOREIGN PATENT DOCUMENTS

| | | | |
|---|---|---|---|
| JP | 57193792 | | 11/1982 |
| WO | 2009005574 | A1 | 1/2009 |

* cited by examiner

COMPRESSOR FOR HIGH EFFICIENCY HEAT PUMP SYSTEM

RELATED APPLICATIONS

This application is a continuation of U.S. patent application Ser. No. 16/718,492 filed Dec. 18, 2019, by Mark W. Olsen, and entitled "COMPRESSOR FOR HIGH EFFICIENCY HEAT PUMP SYSTEM," which claims priority to U.S. Provisional Application No. 62/930,253, filed Nov. 4, 2019, by Mark W. Olsen, and entitled, "COMPRESSOR FOR HIGH EFFICIENCY HEAT PUMP SYSTEM," which are hereby incorporated by reference.

TECHNICAL FIELD

The present disclosure relates generally to heating, ventilation, and air conditioning (HVAC) systems, and more particularly to a compressor for a high efficiency heat pump system.

BACKGROUND

Heating, ventilation, and air conditioning (HVAC) systems are used to regulate environmental conditions within an enclosed space by providing heating and cooling to a space. A heat pump is a type of HVAC system that can be operated in a cooling mode or a heating mode. In the cooling mode, air is cooled via heat transfer with refrigerant flowing through the HVAC system and returned to the space to provide cooling. In the heating mode, air is heated via heat transfer with the refrigerant flowing through the HVAC system and returned to the space to provide heating.

SUMMARY OF THE DISCLOSURE

In an embodiment, a heating, ventilation and air conditioning (HVAC) system, includes a compressor. The compressor includes an inlet port coupled to a suction line of the HVAC system. The suction line is configured to allow flow of refrigerant into the compressor. The HVAC system includes an outlet port coupled to a discharge line of the HVAC system. The discharge line is configured to allow flow of refrigerant out of the compressor. The HVAC system includes a scroll set. The scroll set includes a fixed scroll member and an orbiting scroll member. The fixed scroll member includes a first scroll wrap extending vertically from a base of the fixed scroll wrap. The first scroll wrap has an approximately spiral shape with at least 3.5 rotations from the center to the end of the spiral. The orbiting scroll member includes a second scroll wrap extending vertically from a base of the orbiting scroll wrap. The second scroll wrap has an approximately spiral shape with at least 3.5 rotations from the center to the end of the spiral. The orbiting scroll member is configured to move in an elliptical pattern (e.g., via a shaft coupled to a motor of the compressor) such that fluid entering the inlet port of the compressor is compressed from a first volume to a second volume via movement of the orbiting scroll member.

This disclosure encompasses the recognition that conventional heat pumps have limited utility for providing heating in environments with low ambient outdoor temperatures. Because of this, an alternative heat source, such as a furnace, is generally used to provide heating in cold environments. As such, a previously unmet need exists for heat pumps that can provide heating when ambient outdoor temperatures are low (e.g., less than about 30° F.). The unconventional compressor contemplated in this disclosure overcomes this previously unmet need of by facilitating more efficient heating in low ambient temperature conditions, while still maintaining this high efficiency in more moderate temperature environments. The unique compressor and scroll wrap configurations described in this disclosure particularly facilitate efficient and effective heating without requiring an additional heat source, thereby reducing or eliminating the reliance on non-renewable fuel sources to provide heating in cold climates. Certain embodiments may include none, some, or all of the above technical advantages. One or more other technical advantages may be readily apparent to one skilled in the art from the figures, descriptions, and claims included herein.

BRIEF DESCRIPTION OF THE DRAWINGS

For a more complete understanding of the present disclosure, reference is now made to the following description, taken in conjunction with the accompanying drawings, in which.

DETAILED DESCRIPTION

Figure 1:
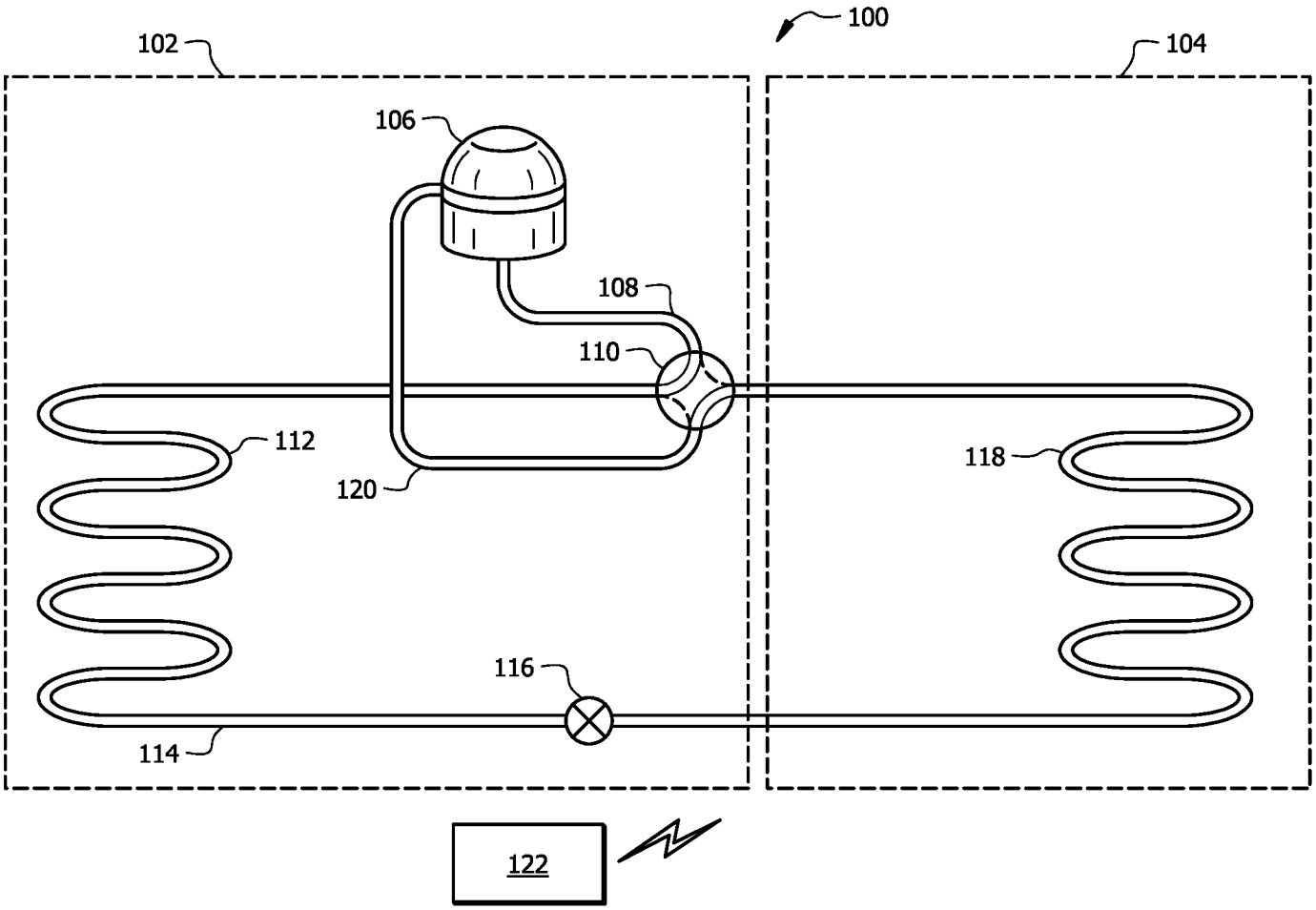
FIG. 1 is a diagram of an example HVAC system.

Embodiments of the present disclosure and its advantages are best understood by referring to FIGS. 1 through 5B of the drawings, like numerals being used for like and corresponding parts of the various drawings. FIG. 1 shows an example HVAC system configured to operate as a heat pump. A heat pump may include a scroll compressor to compress refrigerant for the heating and cooling cycles. Scroll compressors generally include a set of scroll members, including a fixed scroll member and an orbiting scroll member. The orbiting scroll member moves within the fixed scroll member to compress refrigerant (e.g., as described in greater detail with respect to FIGS. 2A and 2B below).

As described in greater detail below with respect to FIGS. 3A, 3B, and 4, this disclosure encompasses the recognition that previous scroll compressors are inefficient when operated at high compression ratios. Compression ratio refers to the ratio of the pressure of refrigerant output by a compressor (e.g., the discharge pressure) to the pressure of refrigerant input to the compressor (e.g., the suction pressure). Generally, the compression ratio is a function of the operating conditions of the HVAC system. For instance, the compression ratio may be relatively low (e.g., near two) for cooling or for moderate heating (e.g., when the outside temperature is 50° F. or greater). However, at lower outside temperatures when more aggressive heating is needed, the compression ratio is generally increased, and the efficiency of previous compressors is low.

Figure 5A:
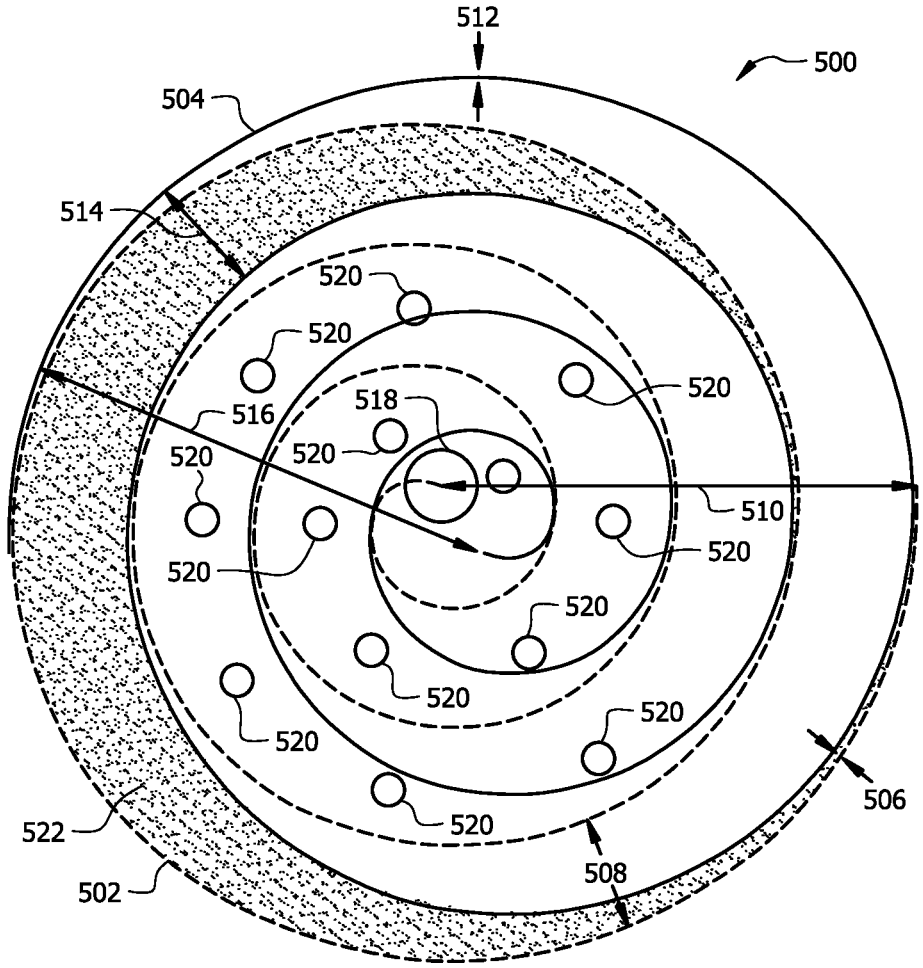
FIGS. 5A and 5B are diagrams of improved scroll sets for use in the example compressor of of FIGS. 2A and 2B.
Figure 5B:
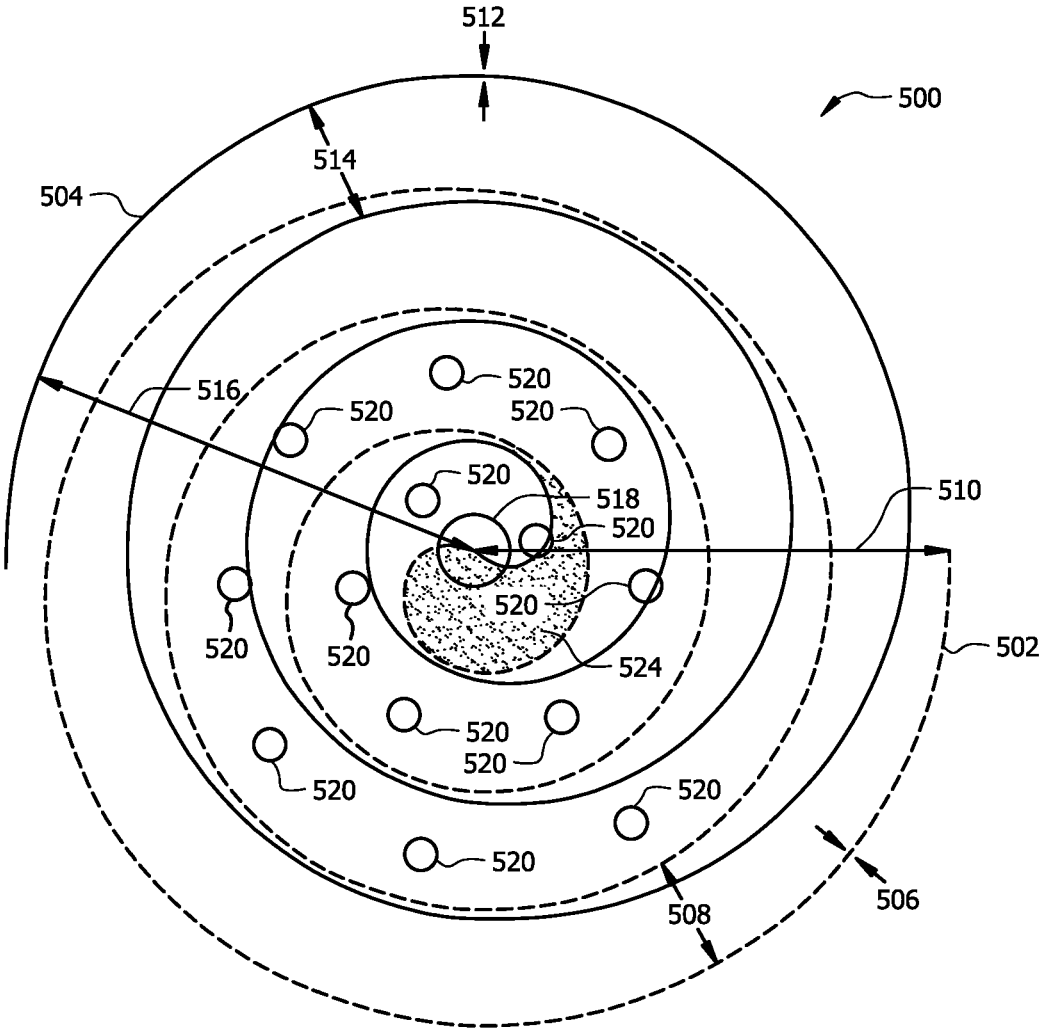

This disclosure provides a unique solution to problems of previous compressor technology, including the previously unrecognized problems described in this disclosure, by providing a more efficient scroll compressor, as illustrated in FIGS. 5A and 5B. This disclosure, in particular, encompasses the recognition that compressor efficiency may be improved when a characteristic volume ratio of the scroll compressor is approximately equal to (e.g., within 40% or so of) the compression ratio at which the HVAC system is operating. The characteristic volume ratio of a scroll compressor, or a of a scroll set of a scroll compressor, generally refers to the ratio of a volume of the refrigerant when it enters the scroll set to the volume of the refrigerant just before exiting the scroll set. Approximately matching the characteristic volume of the scroll set to the highest anticipated compression ratio at which an HVAC system will operate may provide improved efficiency under all operating conditions while also preventing both under-compression and over-compression.

HVAC System

FIG. 1 is a schematic diagram of an embodiment of an HVAC system 100. HVAC system 100 is configured to act as a heat pump. This example HVAC system 100 includes an outdoor unit 102, an indoor unit 104, and a controller 122. The indoor unit 104 may be located inside a space to be heated or cooled, such as a building. The outdoor unit 102 may be placed outside the space. HVAC system 100 may be employed as a residential HVAC system or a commercial HVAC system (e.g., as a rooftop package).

The outdoor unit 102 includes a compressor 106 which compresses a refrigerant and discharges the compressed refrigerant through a discharge line 108. The refrigerant may be any acceptable working fluid including, but not limited to hydroflurocarbons (e.g. R-410A) or any other suitable type of refrigerant. The compressed refrigerant enters a reversing valve 110. The reversing valve 110 can change between a cooling configuration (shown by solid lines) and a heating configuration (shown by dashed lines). For example, the controller 122, which is described in greater detail below may control whether the reversing valve 110 is in the cooling or heating configuration.

The compressor 106 is generally in signal communication with the controller 122 using a wired or wireless connection. The controller 122 may provide commands or signals to control operation of the compressor 106 and/or receives signals from the compressor 106 corresponding to a status of the compressor 106. An example compressor 106 is described in further detail with respect to FIGS. 2 and 5 below.

During operation of the HVAC system 100 in the cooling configuration, the reversing valve is configured according to the solid line shown in FIG. 1, and refrigerant flows from the reversing valve 110 to an outdoor heat exchanger 112. The outdoor heat exchanger 112 may be any appropriate heat exchanger such as coil heat exchanger. During operation of HVAC system 100 in the cooling configuration (solid line orientation of reversing valve 110), the outdoor heat exchanger 112 may act as a condenser. The refrigerant flows through the outdoor heat exchanger 112 and releases heat into the outdoor air. The refrigerant may condense into a liquid as it flows through the outdoor heat exchanger 112. From the outdoor heat exchanger 112, the refrigerant flows through a refrigerant line 114. The refrigerant line 114 may include one or more expansion devices 116. Expansion device 116 generally reduces the pressure of the refrigerant flowing therethrough. In general, the expansion device 116 may be a valve such as an expansion valve or a flow control valve (e.g., a thermostatic expansion valve valve) or any other suitable valve for removing pressure from the refrigerant while, optionally, providing control of the rate of flow of the refrigerant. The expansion device 116 may be in communication with the controller 122 (e.g., via wired and/or wireless communication) to receive control signals for opening and/or closing associated valves and/or provide flow measurement signals corresponding to the rate of refrigerant flow through refrigerant line 114.

Still referring to operation of the HVAC system 100 in the cooling configuration, the expanded refrigerant then flows through an indoor heat exchanger 118, absorbing heat from the air in the space. The indoor heat exchanger 118 be any appropriate heat exchanger such as coil heat exchanger. During operation of HVAC system 100 in the cooling configuration (solid line orientation of reversing valve 110), the indoor heat exchanger 118 may act as an evaporator. Refrigerant in heat exchanger 118 may evaporate such that refrigerant exiting the heat exchanger 118 is in a vapor phase. The refrigerant then flows from the heat exchanger 118 to the reversing valve 110, where it is directed through a suction line 120 and back into the compressor 106 to be compressed again.

During operation of the HVAC system 100 in the heating configuration, reversing valve 110 is configured according to the dashed line shown in FIG. 1, and refrigerant flows from the reversing valve 110 to the indoor heat exchanger 118. As described above the indoor heat exchanger 118 may be any appropriate heat exchanger such as coil heat exchanger. During operation of HVAC system 100 in the heating configuration (dashed line orientation of reversing valve 110), the indoor heat exchanger 118 may act as a condenser. The refrigerant flows through the indoor heat exchanger 118, transferring heat to air that is provided to the space being heated. The refrigerant may condense to a liquid as it flows through the indoor heat exchanger 118. From the indoor heat exchanger 118, the refrigerant flows through the refrigerant line 114. The refrigerant flows to expansion device 116. The expansion device 116 reduces the pressure of the refrigerant flowing therethrough. The expanded refrigerant flows through the outdoor heat exchanger 112, absorbing heat from outdoor air. During operation of HVAC system 100 in the heating configuration (dashed line orientation of reversing valve 110), the outdoor heat exchanger 112 may act as an evaporator. The heated refrigerant may evaporate to form gas-phase refrigerant. The heated refrigerant flows to the reversing valve 110, where it is directed through suction line 120 and back into the compressor 106 to be compressed again.

The HVAC system 100 may further include one or more fans to move air across one or both of the heat exchangers 112 and 118. A blower may provide a flow of air across the indoor heat exchanger 118 and through any air ducts associated with the HVAC system 100. For example, a blower may be a constant-speed or variable-speed circulation blower or fan. Examples of a variable-speed blower include, but are not limited to, belt-drive blowers controlled by inverters, direct-drive blowers with electronic commuted motors (ECM), or any other suitable type of blower. Any fans and/or blowers may be coupled to and controlled by signals received from the controller 122.

The HVAC system 100 may include one or more sensors in communication with controller 122. These sensors may include any suitable type of sensor for measuring air temperature, relative humidity, and/or any other properties of the space being heated or cooled by the HVAC system 100 (e.g. a room or building). Sensors may be positioned anywhere within the space being cooled or heated by the HVAC system 100, the surrounding environment (e.g., outdoors), and/or the HVAC system 100 itself. The HVAC system 100 may include a thermostat in signal communication with the controller 122 using any suitable type of wired or wireless connection. The thermostat may be configured to allow a user to input a desired temperature or temperature setpoint for the space and/or for a designated space or zone, such as a room within the space. The controller 122 may use information from the thermostat for controlling operation of the compressor 106 and/or the reversing valve 110 (e.g., to switch between operation in the cooling and heating configurations described above).

As described above, in certain embodiments, connections between various components of the HVAC system 100 are wired. For example, conventional cable and contacts 'may be used to couple the controller 122 to the various components of the HVAC system 100, including, the compressor 106, the reversing valve, the expansion device 116, and/or any other components (e.g., sensors, thermostats, etc.) of the HVAC system. In some embodiments, a wireless connection is employed to provide at least some of the connections between components of the HVAC system 100. In some embodiments, a data bus couples various components of the HVAC system 100 together such that data is communicated there between. In a typical embodiment, the data bus may include, for example, any combination of hardware, software embedded in a computer readable medium, or encoded logic incorporated in hardware or otherwise stored (e.g., firmware) to couple components of HVAC system 100 to each other. As an example and not by way of limitation, the data bus may include an Accelerated Graphics Port (AGP) or other graphics bus, a Controller Area Network (CAN) bus, a front-side bus (FSB), a HYPERTRANSPORT (HT) interconnect, an INFINIBAND interconnect, a low-pin-count (LPC) bus, a memory bus, a Micro Channel Architecture (MCA) bus, a Peripheral Component Interconnect (PCI) bus, a PCI-Express (PCI-X) bus, a serial advanced technology attachment (SATA) bus, a Video Electronics Standards Association local (VLB) bus, or any other suitable bus or a combination of two or more of these. In various embodiments, the data bus may include any number, type, or configuration of data buses, where appropriate. In certain embodiments, one or more data buses (which may each include an address bus and a data bus) may couple the controller 122 to other components of the HVAC system 100.

The controller may include a processor, a memory, and an input/output (I/O) interface. The processor includes one or more processors operably coupled to the memory. The processor is any electronic circuitry including, but not limited to, state machines, one or more central processing unit (CPU) chips, logic units, cores (e.g. a multi-core processor), field-programmable gate array (FPGAs), application specific integrated circuits (ASICs), or digital signal processors (DSPs) that communicatively couples to memory and controls the operation of HVAC system 100. The processor may be a programmable logic device, a microcontroller, a microprocessor, or any suitable combination of the preceding. The processor is communicatively coupled to and in signal communication with the memory. The one or more processors are configured to process data and may be implemented in hardware or software. For example, the processor may be 8-bit, 16-bit, 32-bit, 64-bit or of any other suitable architecture. The processor may include an arithmetic logic unit (ALU) for performing arithmetic and logic operations, processor registers that supply operands to the ALU and store the results of ALU operations, and a control unit that fetches instructions from memory and executes them by directing the coordinated operations of the ALU, registers, and other components. The processor may include other hardware and software that operates to process information, control the HVAC system 100, and perform any of the functions described herein. The processor is not limited to a single processing device and may encompass multiple processing devices. Similarly, the controller 122 is not limited to a single controller but may encompass multiple controllers.

The memory includes one or more disks, tape drives, or solid-state drives, and may be used as an over-flow data storage device, to store programs when such programs are selected for execution, and to store instructions and data that are read during program execution. The memory may be volatile or non-volatile and may include ROM, RAM, ternary content-addressable memory (TCAM), dynamic random-access memory (DRAM), and static random-access memory (SRAM). The memory is operable to store any data, logic, and/or instructions for performing the function described in this disclosure.

The I/O interface is configured to communicate data and signals with other devices. For example, the I/O interface may be configured to communicate electrical signals with components of the HVAC system 100 including the compressor 106, expansion device 116, and any other components of the HVAC system 100 (e.g., fans, sensors, thermostats, and the like). The I/O interface may include ports or terminals for establishing signal communications between the controller 122 and other devices. The I/O interface may be configured to enable wired and/or wireless communications.

As described above, the example HVAC system 100 is capable of both heating and cooling. An HVAC system that can perform both may be called a heat pump. An air conditioner or heater may be substituted for HVAC system 100. An air conditioner is an HVAC system which is capable of cooling, while a heater is an HVAC system which is capable of heating. In an alternative configuration of the HVAC system 100 that is capable of either heating or cooling, but not both, the reversing valve 110 may not be included because the direction of refrigerant flow does not reverse.

Scroll Compressor

Figure 2A:
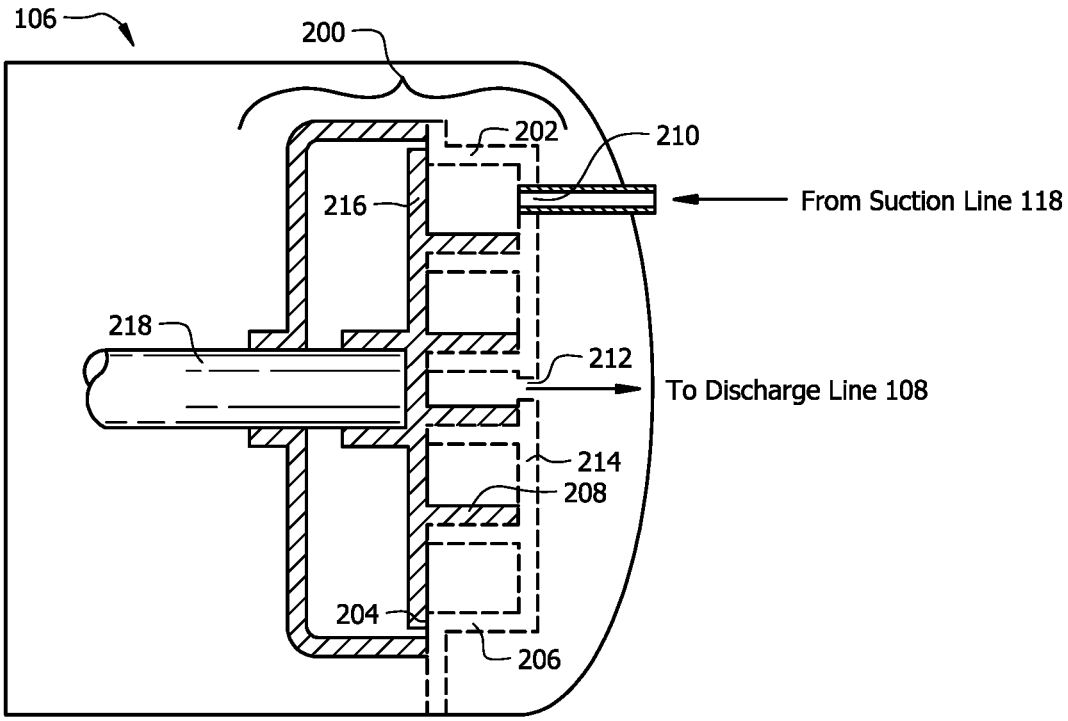
FIG. 2A is a diagram of a portion of a scroll compressor for use in the HVAC system illustrated in FIG. 1.
Figure 2B:
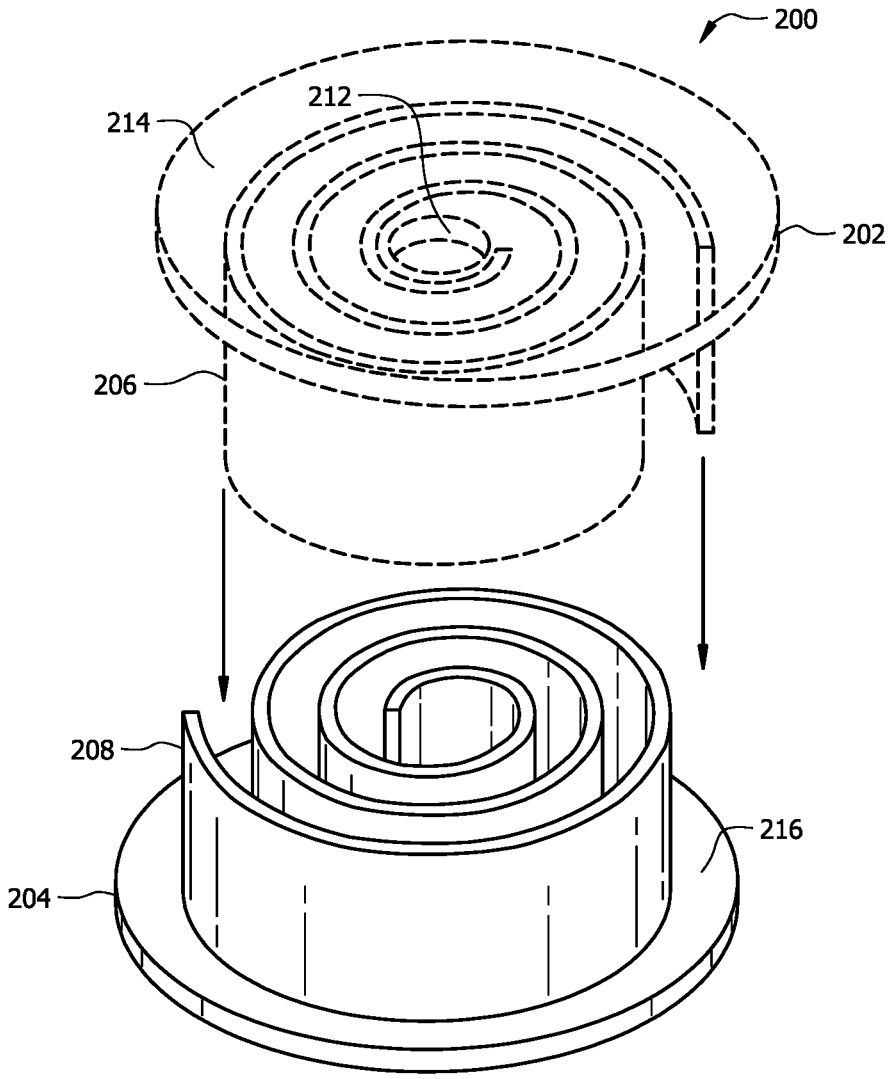
FIG. 2B is a diagram of a scroll set for use in the scroll compressor illustrated in FIG. 2A.

FIG. 2A shows a portion of an example compressor 106 of the HVAC system 100 of FIG. 1. The example compressor 106 is a scroll compressor, which includes a scroll set 200. The scroll set 200 includes a fixed scroll member 202 and an orbiting scroll member 204. The fixed scroll member 202 includes a scroll wrap 206, and the orbiting scroll member 204 includes a scroll wrap 208. FIG. 2B illustrates the scroll set 200 from a perspective view with the separate scroll members 202, 204 separated. The scroll wraps 206, 208 have an approximately spiral shape. An approximately spiral shape generally corresponds to a shape comprising a curve which gradually widens from a central point. In some embodiments, the approximately spiral shape of the scroll wraps 206, 208 corresponds to the shape of an involute curve (e.g., an involute curve of a circle or an ellipse). For instance, the scroll wraps 206, 208 may have the shape of an involute of an ellipse with a first radius (a) in a range from about 1 mm to about 10 mm and a second radius (b) in a range from about 1 mm to about 10 mm. The (x, y) coordinates of such an involute shape may be given by:

$$x=a\cos(t)$$

$$y=b\sin(t)$$

where t is a value from zero to the length of the involute curve.

In some embodiments, the first radius (a) is equal to the second radius (b) such that the shape of the scroll wraps 206, 208 is the involute curve of a circle. In other embodiments, the ratio of the first radius (a) to the second radius (b) is at least 1.05, such that the shape of the scroll wraps 206, 208 is the involute curve of an ellipse where the radius of the major axis of the ellipse (i.e., the first radius) is at least 5% larger than the radius of the minor axis of the ellipse (i.e., the second radius). The scroll wrap 206 of the fixed scroll member 202 fits within the space between the scroll wrap 208 of the orbiting scroll member 204.

During operation of the compressor 106, the orbiting scroll member 204 is moved in an approximately circular or elliptical pattern such that the orbiting wrap 208 moves within the fixed wrap 206, and a volume of refrigerant is trapped between the wraps 206, 208 and compressed from an initial volume to a final volume. For instance, refrigerant trapped between the scroll wrap 206 of the fixed scroll member 202 and the scroll wrap 208 of the orbiting scroll member 204 is compressed from an initial volume (corresponding to area 522 illustrated in FIG. 5A) to a final volume (corresponding to the size of area 524 illustrated in FIG. 5B). As described in greater detail with respect to FIGS. 5A and 5B below, the unique scroll set configuration 500 described in this disclosure facilitates improved efficiency of the compressor 106 and thereby improved efficiency of the HVAC system 100. Appropriately positioned bypass ports 520, described in greater detail below with respect to FIGS. 5A and 5B prevent over-compression during cooling or heating when the outside temperature is higher (e.g., about 50° F. or greater).

Referring again to FIG. 2A, the scroll set 200 is configured to receive refrigerant via input 210 from the suction line 120 (see FIG. 1), compress the refrigerant via motion of the orbiting scroll member 204, and output the refrigerant via outlet port 212 to discharge line 108 (see FIG. 1). Input 210 may be located in the base 214 of the fixed scroll member 202, as illustrated in FIG. 2A, or in any other appropriate location. The orbiting scroll member 204 is coupled at its base 216 to a shaft 218 which is coupled to a motor (not shown) of the compressor 106. Operation of the motor causes the shaft 218 to move in an approximately circular or elliptical pattern such that the orbiting scroll member 204 moves within the fixed scroll member 202. The fixed scroll wrap 202 and orbiting scroll wrap 204 each has an approximately spiral shape with about 2.5 rotations from the center of the approximately spiral-shaped curve to the end of the curve.

Figure 3A:
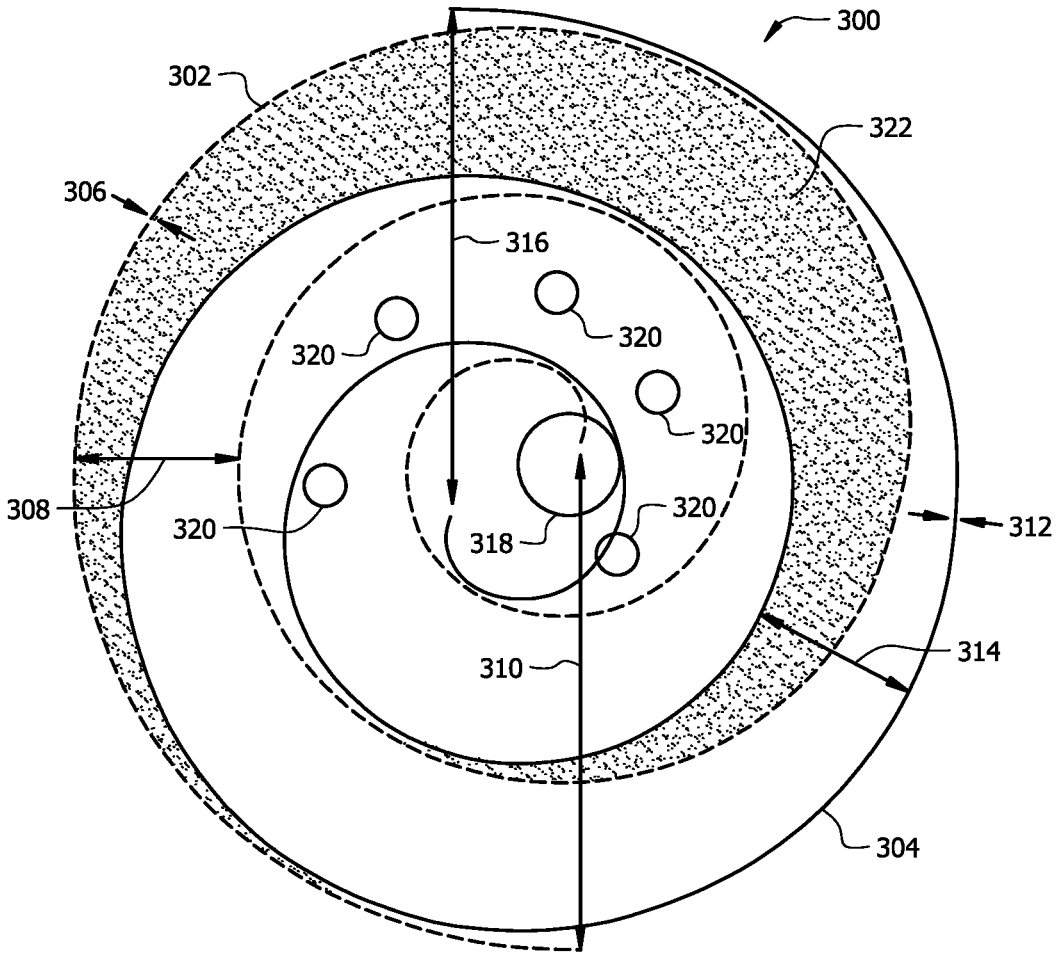
FIG. 3A (Prior Art)
FIGS. 3A and 3B are diagrams of previous scroll sets used in compressors for HVAC systems.
Figure 3B:
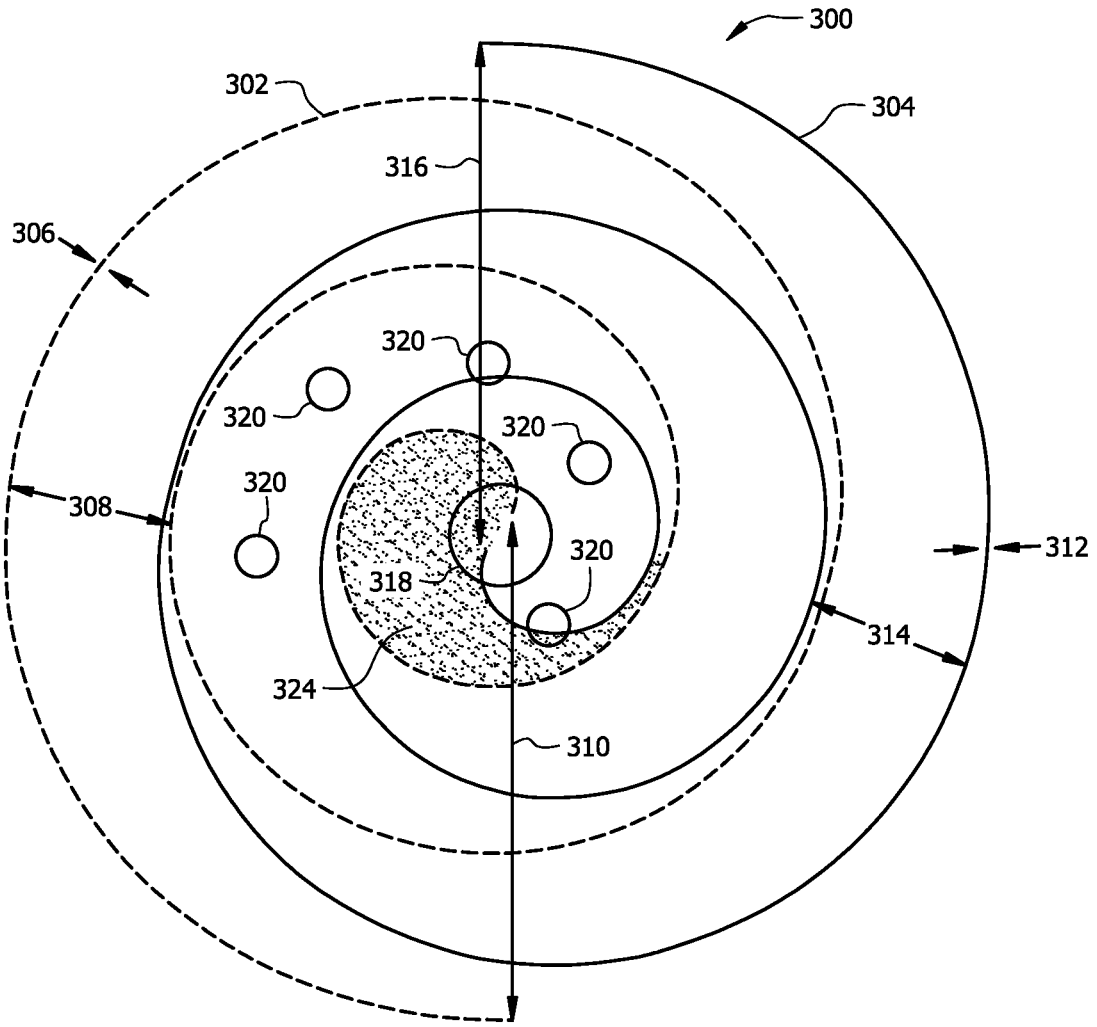
FIG. 3B (Prior Art)

An example of a previous scroll wrap configuration is illustrated in FIGS. 3A and 3B in an initial (FIG. 3A) and final (FIG. 3B) configuration. FIG. 3A shows the scroll set 300 when refrigerant is initially trapped in area 322 between scroll sets 302, 304 (e.g., upon entering the scroll set 300), while FIG. 3B shows the scroll set 300 after the orbiting scroll member 204 has moved and the refrigerant occupies area 324 before being released through discharge port 318. The scroll set 300 illustrated in FIGS. 3A and 3B may be used as the scroll set 200 of FIGS. 2A and 2B. For example, the orbiting scroll wrap 302 may be the scroll wrap 206 of the fixed scroll member 202 of FIGS. 2A and 2B. The orbiting scroll wrap 304 may be the scroll wrap 208 of the orbiting scroll member 204 of FIGS. 2A and 2B. The thickness 306 of the fixed scroll wrap 302 is about 4 mm. The distance 308 between lines of the scroll wrap 302 is about 11 mm. The radius 310 of the fixed wrap 302 is about 45 mm. Similarly, the thickness 312 of the orbiting scroll wrap 304 is about 4 mm. The distance 314 between lines of the orbiting scroll wrap 304 is about 11 mm. The radius 316 of the orbiting scroll wrap 304 is about 45 mm. The discharge port 320 is an opening in the base 214 of the fixed scroll member 202 through which compressed refrigerant passes to reach the discharge line 108 (see FIGS. 1 and 2A-B). Bypass ports 320 may facilitate the release of refrigerant to the discharge line 108. Release valves may be positioned on the back side of the base 214 of the fixed scroll member 202 (i.e., on the discharge side of the bypass ports 320) in order to control the release of refrigerant through the bypass ports 320.

Based on the dimensions described above, the scroll set 300 has a characteristic volume ratio, which is the ratio of the initial volume of fluid entering the scroll set 300 (i.e., the initial volume associated with area 322 shown in FIG. 3A which refrigerant occupies upon entering the space between scroll wraps 302, 304) to the final volume of the refrigerant exiting the scroll set 300 out of discharge port 318 (i.e., the final volume associated with area 324 shown in FIG. 3B which refrigerant occupies). The characteristic volume ratio of previous scroll sets, such as the example scroll set 300, is typically about two.

Previous scroll sets, such as the one described above with respect to FIGS. 3A and 3B, have several drawbacks and limitations, the recognition of which is encompassed by this disclosure. For example, during operation of HVAC system 100 where the compressor 106 has scroll set 300 as shown in FIGS. 3A and 3B, the compressor 106 may not provide adequate compression for certain heating tasks. For example, the compressor 106, with scroll wraps 302, 304 configured as illustrated in FIGS. 3A and 3B, may not provide adequate compression for heating when the outside temperature is less than a threshold temperature (e.g., of 30° F. or less). In some cases, in order to reach an appropriate level of compression (i.e., to reach a sufficiently high pressure on the discharge side of the compressor 106) the orbiting scroll member 204 must complete multiple orbits (i.e., the shaft 218 must make multiple rotations in its circular or elliptical pattern) in order for refrigerant in the scroll set 200 to reach a required discharge pressure before the compressed refrigerant is released to the discharge line 108. This results in a significant decrease in both compressor efficiency and the overall efficiency of the HVAC system 100.

Figure 4:
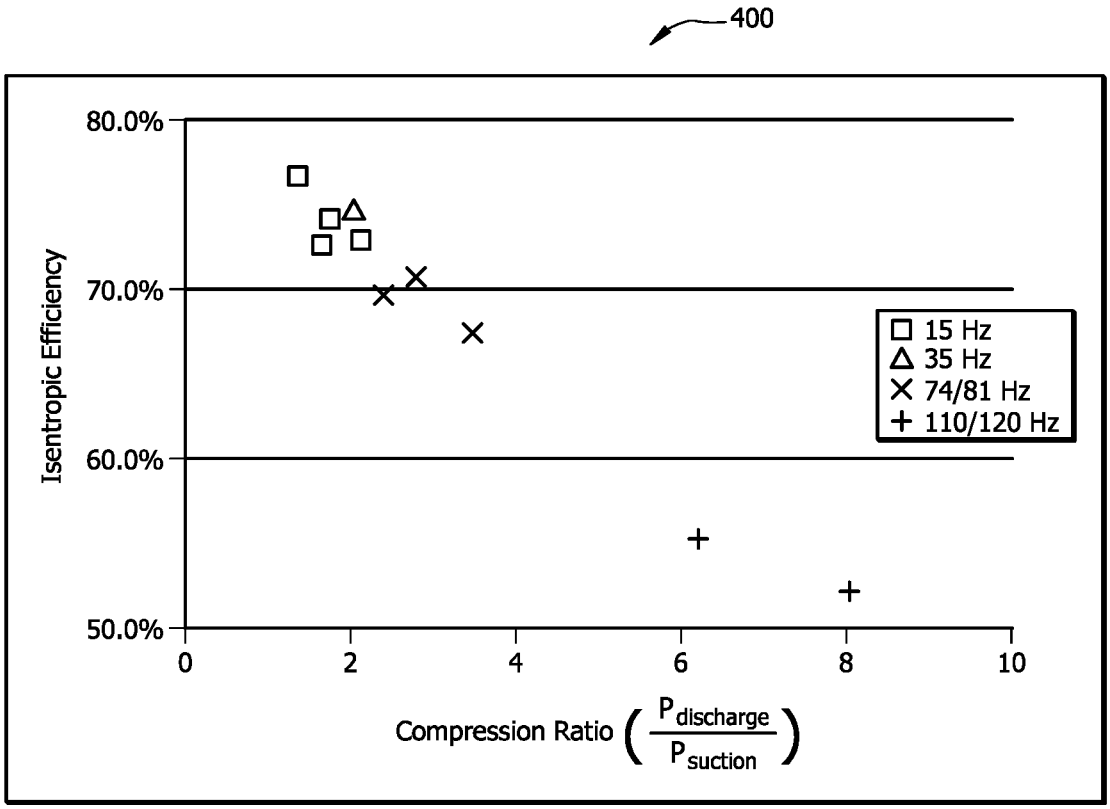
FIG. 4 is graph of isentropic efficiency of a previous compressor as a function of compression ratio.

This newly recognized problem associated with the operation of previous scroll compressors, particularly in cold environments, is illustrated in plot 400 of FIG. 4, which shows the isentropic efficiency of a previous compressor with a characteristic volume ratio of about two as a function of compression ratio. Isentropic efficiency is generally a measure of the actual amount of power consumed by the compressor 106 during compression divided by the amount of power that would be consumed for an idealized version of the same compression process (i.e., the same compression process at constant entropy). The compression ratio is the ratio of the pressure of refrigerant flowing out of the compressor 106 (i.e., in the discharge line 108) to the pressure of refrigerant flowing into the compressor 106 (i.e., in the suction line 120). When an HVAC system 100 operates in the heating configuration (see FIG. 1 and corresponding description above) and the outside temperature is below a threshold temperature, the HVAC system 100 generally operates at a high compression ratio. For example, the data points in FIG. 4 at compression ratios of 6 and 8, where the efficiency of the compressor is lowest, were recorded at outside temperatures of about 17° F. and 5° F., respectively. This disclosure encompasses the recognition that the efficiency of the compressor 106 is improved when the characteristic volume ratio raised to the 1.18 power of a scroll set 200 is near the value of the compression ratio at which the HVAC system 100 is operating and that efficiency decreases when the volume ratio raised to the 1.1.8 power of the scroll set 200 is less than the compression ratio at which the HVAC system 100 is operating.

Improved Scroll Wrap Configuration

FIGS. 5A and 5B illustrate an improved configuration of a scroll set 500 which has an increased characteristic volume ratio (i.e., the ratio of the volume associated with area 522 of FIG. 5A to the volume associated with area 524 of FIG. 5B) for improved efficiency. FIG. 5A shows scroll set 500 when refrigerant is initially trapped in area 522 between scroll sets 502, 504 (e.g., upon entering scroll set 500), while FIG. 5B shows scroll set 500 after the orbiting scroll member 204 has moved and the refrigerant occupies area 524. Scroll set 500 has a characteristic volume ratio (e.g., the ratio of the volume associated with area 522 to the volume associated with area 524) of at least four. Scroll wrap configuration 500 provides improved efficiency at high compression ratios (e.g., when the HVAC system is operating in a heating configuration at low outside temperatures). Bypass ports 520 prevent over-compression under other operating conditions (e.g., during operation in a cooling configuration or during heating at relatively warmer outside temperatures).

Scroll set 500 includes a fixed scroll wrap 502 and an orbiting scroll wrap 504. The fixed scroll wrap 502 is the scroll wrap 206 of the fixed scroll member 202 of FIGS. 2A and 2B. The orbiting scroll wrap 504 is the scroll wrap 208 of the orbiting scroll member 204 of FIGS. 2A and 2B. The thickness 506 of the fixed scroll wrap 502 is generally about 4 mm. The thickness 506 may variably along the length of the scroll wrap 502 if appropriate. The distance 508 between lines of the scroll wrap 502 is generally about 11 mm. The radius 510 of the fixed scroll wrap 502 is generally at least 60 mm. In other words, the radius 510 of the fixed scroll wrap 502 of FIGS. 5A and 5B is at least 50% larger than the radius 310 of the conventional scroll wrap 302 shown in FIGS. 3A and 3B. The thickness 512 of the orbiting scroll wrap 504 is generally about 4 mm. The thickness 512 may be variable along the length of the scroll wrap 504 as appropriate. The distance 514 between lines of the orbiting scroll wrap 504 is generally about 11 mm. The radius 516 of the orbiting scroll wrap 504 is generally at least 60 mm, or at least 50% larger than the radius 316 of the conventional orbiting scroll wrap 304 shown in FIGS. 3A and 3B. The example fixed scroll wrap 502 and orbiting scroll wrap 504 each has an approximately spiral shape with about 3.5 rotations from the center of the approximately spiral-shaped curves of wraps 502, 504 to the end of the curves. Other embodiments of the fixed scroll wrap 502 and orbiting scroll wrap 504 have greater than 3.5 rotations. Other embodiments of scroll wraps 502, 504 include curves with four, five, six, seven, eight, or more rotations.

The discharge port 520 is an opening in the base 214 of the fixed scroll member 202 through which compressed refrigerant passes to reach the discharge line 108 (see FIGS. 1 and 2A-B). Bypass ports 520 facilitate the release of refrigerant (e.g., based on the pressure of the refrigerant when the refrigerant is in contact with the bypass ports 520) to the discharge line 108 in order to prevent or limit over-compression by the compressor 106. Release valves may be positioned on the back side of the base 214 of the fixed scroll member 202 (i.e., on the discharge side of bypass ports 520) in order to control the release of refrigerant through the bypass ports 520. This can aid in preventing over-compression by the compressor 106 by allowing refrigerant to be released to the discharge line 108 when a predetermined pressure is reached at the positions of the bypass ports 520 (e.g., to achieve a desired compression ratio).

Based on the dimensions described above, scroll set 500 has a characteristic volume ratio, which is the ratio of the initial volume of fluid entering scroll set 500 (i.e., the initial volume associated with area 522 refrigerant occupies upon entering the space between the scroll wraps 502, 504) to the final volume of the refrigerant exiting the scroll set 500 out of discharge port 518 (i.e., the final volume associated with area 524). The characteristic volume ratio of scroll set 500 is at least four. In other embodiments, the characteristic volume ratio is greater than four (e.g., radius 510 and radius 516 may be greater than 60 mm). For instance, the characteristic volume ratio may be five, six, seven, eight, or greater. In general any appropriate size scroll set 500 (e.g., any appropriate radius 510 and radius 516 and/or any appropriate number of rotations) may be employed such that the volume ratio is four or greater. In some cases, the characteristic volume ratio to the power of 1.18 is approximately equal to the compression ratio at which the HVAC system 100 is operating (e.g., or a maximum compression ratio at which the HVAC system 100 is expected to commonly operate). As used in this disclosure, the term "approximately equal" generally refers to a first value (e.g., the volume ratio to the power of 1.18) being within a predefined threshold from a second value (e.g., the compression ratio). For instance, in various embodiments, a value of the volume ratio to the power of 1.1.8 that is within the value of the volume ratio to the power of 1.18 is considered to be approximately equal to the compression ratio when the value of the volume ratio to the power of 1.18 is within 20%, 15%, 10%, 5%, 1%, or less of the value of the compression ratio. In an example embodiment, the value of the volume ratio to the power of 1.18 is considered to be approximately equal to the compression ratio when the value of the volume ratio to the power of 1.18 is within 5% of the compression ratio. In yet another example embodiment, the value of the volume ratio to the power of 1.18 is approximately equal to the compression ratio when the volume ratio to the power of 1.18 is within 1% of the compression ratio.

While several embodiments have been provided in the present disclosure, it should be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and could be made without departing from the spirit and scope disclosed herein.

To aid the Patent Office, and any readers of any patent issued on this application in interpreting the claims appended hereto, applicants note that they do not intend any of the appended claims to invoke 35 U.S.C. § 112(f) as it exists on the date of filing hereof unless the words "means for" or "step for" are explicitly used in the particular claim.

What is claimed is:

1. A heating, ventilation and air conditioning (HVAC) system, comprising a compressor, the compressor comprising:

an inlet port coupled to a suction line of the HVAC system, the suction line configured to allow flow of refrigerant into the compressor;

an outlet port coupled to a discharge line of the HVAC system, the discharge line configured to allow flow of refrigerant out of the compressor; and a scroll set comprising:

a fixed scroll member comprising a first scroll wrap extending vertically from a base of the fixed scroll wrap, the first scroll wrap having an approximately spiral shape with a plurality of rotations from the center to the end of the spiral; and an orbiting scroll member comprising a second scroll wrap extending vertically from a base of the orbiting scroll wrap, the second scroll wrap having an approximately spiral shape with a plurality of rotations from the center to the end of the spiral, wherein the orbiting scroll member is configured to move in an elliptical pattern such that fluid entering the inlet port is compressed from a first volume to a second volume via movement of the orbiting scroll member;

wherein a distance between adjacent lines of the approximately spiral shaped first scroll wrap, a distance between adjacent lines of the approximately spiral shaped second scroll wrap, and a radius of the second scroll wrap are configured such that a ratio of the first volume ($V_1$) to the second volume ($V_2$) to the power of 1.18 ($(V_1/V_2)^{1.18}$) is within 5% of a maximum compression ratio of the HVAC system, wherein the maximum compression ratio corresponds to a ratio of a discharge pressure of refrigerant flowing in the discharge line to a suction pressure of refrigerant flowing in the suction line when the HVAC system is operating in a heating configuration.

2. The HVAC system of claim 1, wherein the maximum compression ratio corresponds to when the HVAC system is operated in the heating configuration and the outside air temperature is less than a predetermined threshold temperature.

3. The HVAC system of claim 2, wherein the predetermined threshold temperature is 30° F.

4. The HVAC system of claim 1, wherein the ratio of the first volume to the second volume is 4 or greater.

5. The HVAC system of claim 1, wherein the radius of the second scroll wrap is 60 mm or greater.

6. A compressor, the compressor comprising:

an inlet port coupled to a suction line of an HVAC system, the suction line configured to allow flow of refrigerant into the compressor;

an outlet port coupled to a discharge line of the HVAC system, the discharge line configured to allow flow of refrigerant out of the compressor; and a scroll set comprising:

a fixed scroll member comprising a first scroll wrap extending vertically from a base of the fixed scroll wrap, the first scroll wrap having an approximately spiral shape with a plurality of rotations from the center to the end of the spiral; and an orbiting scroll member comprising a second scroll wrap extending vertically from a base of the orbiting scroll wrap, the second scroll wrap having an approximately spiral shape with a plurality of rotations from the center to the end of the spiral, wherein the orbiting scroll member is configured to move in an elliptical pattern such that fluid entering the inlet port is compressed from a first volume to a second volume via movement of the orbiting scroll member;

wherein a distance between adjacent lines of the approximately spiral shaped first scroll wrap, a distance between adjacent lines of the approximately spiral shaped second scroll wrap, and a radius of the second scroll wrap are configured such that a ratio of the first volume ($V_1$) to the second volume ($V_2$) to the power of 1.18 ($(V_1/V_2)^{1.18}$) is within 5% of a maximum compression ratio of the HVAC system comprising the scroll compressor, wherein the maximum compression ratio corresponds to a ratio of a discharge pressure of refrigerant flowing in the discharge line of the HVAC system to a suction pressure of refrigerant flowing in the suction line of the HVAC system, when the HVAC system is operating in a heating configuration.

7. The compressor of claim 6, wherein the maximum compression ratio corresponds to when the HVAC system is operated in the heating configuration and the outside air temperature is less than a predetermined threshold temperature.

8. The compressor of claim 7, wherein the predetermined threshold temperature is 30° F.

9. The compressor of claim 6, wherein the ratio of the first volume to the second volume is 4 or greater.

10. The compressor of claim 6, wherein the radius of the second scroll wrap is 60 mm or greater.

11. A scroll set for a scroll compressor, the scroll set comprising:

a fixed scroll member comprising a first scroll wrap extending vertically from a base of the fixed scroll wrap, the first scroll wrap having an approximately spiral shape with a plurality of rotations from the center to the end of the spiral; and an orbiting scroll member comprising a second scroll wrap extending vertically from a base of the orbiting scroll wrap, the second scroll wrap having an approximately spiral shape with a plurality of rotations from the center to the end of the spiral, wherein the orbiting scroll member is configured to move in an elliptical pattern such that fluid entering an inlet port of the scroll compressor is compressed from a first volume to a second volume via movement of the orbiting scroll member;

wherein a distance between adjacent lines of the approximately spiral shaped first scroll wrap, a distance between adjacent lines of the approximately spiral shaped second scroll wrap, and a radius of the second scroll wrap are configured such that a ratio of the first volume ($V_1$) to the second volume ($V_2$) to the power of 1.18 ($(V_1/V_2)^{1.18}$) is within 5% of a maximum compression ratio of an HVAC system comprising the scroll compressor, wherein the maximum compression ratio corresponds to a ratio of a discharge pressure of refrigerant flowing in a discharge line of the HVAC system to a suction pressure of refrigerant flowing in a suction line of the HVAC system, when the HVAC system is operating in a heating configuration.

12. The scroll set of claim 11, wherein the maximum compression ratio corresponds to when the HVAC system is operated in the heating configuration and the outside air temperature is less than a predetermined threshold temperature.

13. The scroll set of claim 12, wherein the predetermined threshold temperature is 30° F.

14. The scroll set of claim 11, wherein the ratio of the first volume to the second volume is 4 or greater.

* * * * *